United States Patent [19]

Kemp

[11] 4,379,725

[45] Apr. 12, 1983

[54] PROCESS FOR HOT ISOSTATIC PRESSING OF A METAL WORKPIECE

[76] Inventor: Willard E. Kemp, 1035 Dairy Ashford, Suite 146, Houston, Tex. 77079

[21] Appl. No.: 346,503

[22] Filed: Feb. 8, 1982

[51] Int. Cl.[3] ..... C21D 1/53; C21D 1/78

[52] U.S. Cl. ..... 148/4; 148/13; 148/20.3; 432/58; 432/205

[58] Field of Search ..... 148/4, 3, 13, 20.3; 432/58, 197, 205, 215

[56] References Cited

U.S. PATENT DOCUMENTS

| | | | |
|---|---|---|---|
| 3,397,873 | 8/1968 | Ritchie et al. | 432/215 |
| 4,222,429 | 9/1980 | Kemp | 148/3 |
| 4,249,889 | 2/1981 | Kemp | 432/197 |
| 4,250,610 | 2/1981 | Wilbess et al. | 148/11.5 R |
| 4,302,256 | 11/1981 | Kenton | 148/4 |
| 4,340,433 | 7/1982 | Harding | 148/20.3 |

FOREIGN PATENT DOCUMENTS

| | | | |
|---|---|---|---|
| 2523952 | 12/1976 | Fed. Rep. of Germany | 432/58 |
| 53-45613 | 4/1978 | Japan | 148/3 |

*Primary Examiner*—Peter K. Skiff
*Attorney, Agent, or Firm*—Vaden, Eickenroht, Thompson, Bednar & Jamison

[57] ABSTRACT

A process for hot isostatic pressing of a metal workpiece, such as a ferrous casting. The workpiece is heated in a fluidized particulate bed (sand) to a temperature above the plastic range of the metal (e.g. 2000° F.). Then, the workpiece in the unfluidized bed at this temperature is subjected to a superatmospheric gas pressure above 20,000 psi until internal mechanical property changes have occurred. Lastly, the workpiece is removed from the bed and superatmospheric pressure environment for subsequent utilization.

13 Claims, 2 Drawing Figures

PROCESS FOR HOT ISOSTATIC PRESSING OF A METAL WORKPIECE

BACKGROUND OF THE INVENTION

1. Field of the Invention

This invention pertains to the manufacture of metal workpieces, and more particularly, it relates to hot isostatic pressing of metal workpieces.

2. Description of the Prior Art

In the manufacture of metal workpieces, especially those formed by the casting of ferrous metal (e.g. steel), improvements in the mechanical properties are necessary for a satisfactory product. For example, the casting, at a temperature above the plastic range of the metal, is subjected to mechanical working. For cast steel, this temperature is at least 2000° F. The mechanical working can be by rolling, forging, pressing and other mechanical pressure applications that effect structural changes that improve the mechanical properties of the workpiece. For example, hot mechanical working reduces the internal defects of steel products attributed to segregation, cracks, seams, and inclusions. The term ferrous metal includes all of its forms such as wrought iron and steel.

It has been proposed to employ hot isostatic pressing of metal workpieces to obtain similar internal improvements as can be obtained by hot mechanical working. In hot isostatic pressing, the metal workpiece, while at a temperature in the plastic range is subjected uniformly on all three axis to superatmospheric gas pressure (e.g. 20,000 psi) until the internal mechanical properties are improved, especially the reduction of internal voids. However, the problems in maintaining the metal workpiece at the necessary elevated temperature during isostatic pressure application has prevented satisfactory application of the hot isostatic pressing procedures especially to complex castings. The extremely high pressures prevent continuous heating of the workpiece during the pressing step.

It is the purpose of this invention to provide an improved process of hot isostatic pressing wherein the metal workpiece remains uniformly throughout at a uniform temperature in the plastic range of the metal.

SUMMARY OF THE INVENTION

The present invention is a process for treating a metal workpiece by several unique steps. The workpiece is subjected to a heated fluidized bed until the workpiece reaches a temperature in the plastic range of the metal. Then, fluidization of the bed is terminated. The workpiece in the bed is subjected to superatmospheric gas pressure at the mentioned temperature until the pressure and temperature dependent internal mechanical changes have occurred in the metal. Then, the workpiece is removed from the bed and superatmospheric pressure environment for subsequent utilization.

DESCRIPTION OF PREFERRED EMBODIMENT

The present process of hot isostatic pressing is applicable to many metal workpieces wherein hot working can produce internal structural changes for product improvement.

The present process can be used to heat treat a steel workpiece, such as a casting. The workpiece can have been made some time prior to practice of the present process. However, it is preferred to subject the workpiece to the steps of this process while it is yet at casting temperatures to conserve heat energy. In the present description, the metal workpiece will be described as a freshly made casting, such as can be produced by the procedure of U.S. Pat. No. 4,222,429.

Figure 1:
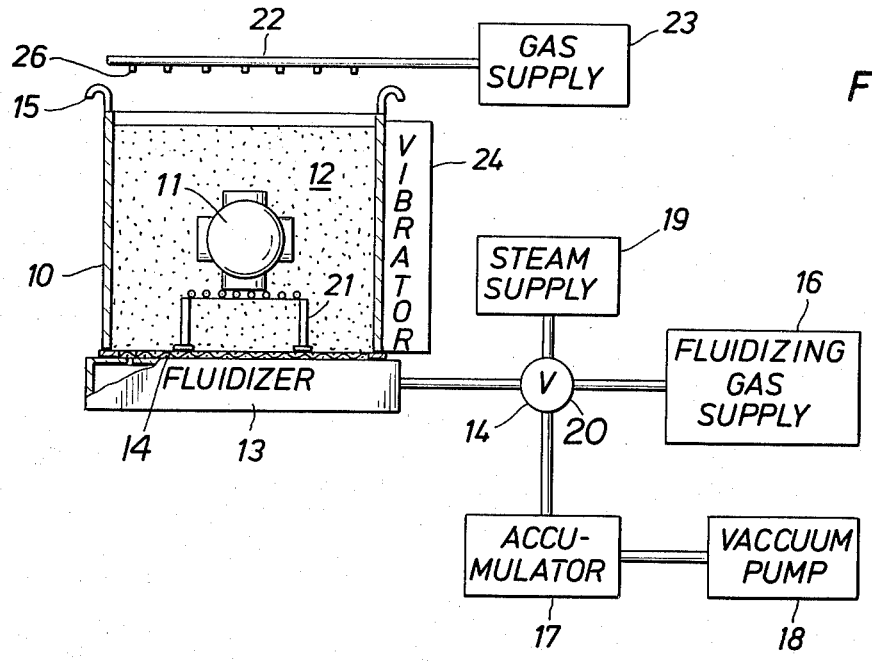
FIG. 1 is a schematic illustrating an apparatus with fluidized bed which may be employed in practicing the present process.

In this embodiment of the present process, the metal workpiece 11 is a steel casting shown as a large (200 pound) complex spherical valve body which was cast in the apparatus shown in FIG. 1. However, other metal castings of different sizes and shapes may be produced with equal facility, and in other apparatus than will be specifically described herein.

As shown in FIG. 1, the casting container 10 is filled with the particulate bed 12, which may be sand, or other refactory constituents. The open topped container 10 with imperforate sidewalls, is adapted to receive a flow of fluid, such as air, through an integral diffuser bottom member such as a fine mesh screen 14 from a fluidizer 13. The container 10 is adapted by lifting hooks 15, or the like, for easy transfer by a crane (not shown) from the fluidizer 13 to another process location. However, the fluidizer 13 can be moved with the container 10 if these parts are integrally connected, or for other reasons.

A fluid source system is connected to the fluidizer 13, and provides for the flow of fluid upwardly through bed 12, or alternatively, aspirates fluid downwardly from the bed 12 into the fluidizer 13. For this purpose, the fluidizer 13 is connected through a selector valve 20 to a fluidizer gas supply 16, a source of vacuum or reduced pressure which includes an accumulator 17 and vacuum pump 18, and a source of heat energy or a coolant such as steam supply 19. The gas supply 16 is arranged to provide a suitable flow of pressurized fluid, such as air, which is passed upwardly through the bed 12 at a velocity of 100 feet per minute for large particle sizes and only about 3–30 feet per minute for small particle sizes. Stated in another manner, the flow of fluid in the bed provides a pressure drop of approximately 1 p.s.i. for each foot of depth in the bed 12. The bed 12 usually will be selected from sand particles with sizes between 30–250 mesh (American Foundry Screen).

The workpiece 11 is supported upon a framework 21 resting upon screen 14. If the workpiece 11 was not cast in the bed 12, the valve body workpiece is placed into the bed when it is fluidized.

In many cases, the casting of the metal workpiece 11 will heat the bed to near a temperature in the plastic range of the metal. Therefore, only a small adjustment in temperature of the bed and workpiece will be needed.

The bed 12 can be heated or cooled by fluid flow from the gas supply 16. Also, heating may be provided by combustion gas introduced into the bed 12 through a manifold pipe 22 from a suitable gas supply 23. The manifold pipe 22 has a plurality of combustion nozzles 26 facing downwardly so that combustion heating gas is applied directly to the bed 12. Also, the supply 16 may provide a combustible mixture directly into a priorly heated bed 12 so that surface or flameless combustion occurs insitu on the bed particle's surface. This mode of insitu heating is of advantage in burn out of carbon residue in the bed 12 and scale reduction on the workpiece 11. The heating of the bed may be accomplished by combining several of these heating mechanisms. Where the workpiece 11 is steel, the bed should be heated to at least 2000° F., and preferably between 2000° F. and 2600° F.

Now, the bed 12 is no longer fluidized. With the nonfluidized bed 12 packed about the workpiece, it can remain for long periods of time at a constant uniform temperature in the heated bed without suffering warping, corrosion or scale problems since air flow is excluded for all practical purposes.

The fluidized bed 12 is a good heat conductive medium and is a superior heat conductor than the metal workpiece. The bed particles exchange heat dynamically with the workpiece 11. Initially, the flow of heat between the bed and the workpiece is at a high rate which decreases as they approach the same temperature. Because of the efficient transfer of heat from a fluidized bed to a metal workpiece, the bed and workpiece quickly reach the same temperature. Most importantly, the fluidized bed 12 and the workpiece are generally at a uniform temperature irrespective of its use in heating or cooling the workpiece.

The bed 12, when not fluidized, has a very low thermal conductivity. Therefore, a near equilibrium condition is quickly reached in a thin layer (e.g., one-half inch) in the bed about the workpiece. Thus, if the bed and workpiece begin a "heat soak" period, the workpiece will remain at a relatively constant temperature for greatly extended periods of time. For example, the bed 12 at 2000° F. may let the workpiece 11 cool with the container 10 in open air only about 50° F. over a 5 hour period.

Although the present bed 12 is adapted for both heating and cooling operation, a plurality of the beds may be employed, each bed adjusted to the desired temperature in the critical range after being used in the hot isostatic pressing of the workpiece as will be described hereinafter. Obviously, the workpiece could be transferred between several heated beds in a stepwise temperature adjustment in the present process or for heat recovery reasons.

It is sometimes desired that the mass of the bed 12 be sufficiently greater than the workpiece 11 that the temperature of the bed remains relatively constant during and after bed fluidization. Thus, the heat capacity of the workpiece cannot significantly change the temperature of the bed 12.

The heating or cooling of the workpiece to the desired temperature within the critical range can be precisely provided by the large heat sink of the particulate bed. The bed's fluidization can be controlled to provide a uniform rate of temperature change in regulated and uniform heat transfer between the workpiece and the bed.

Figure 2:
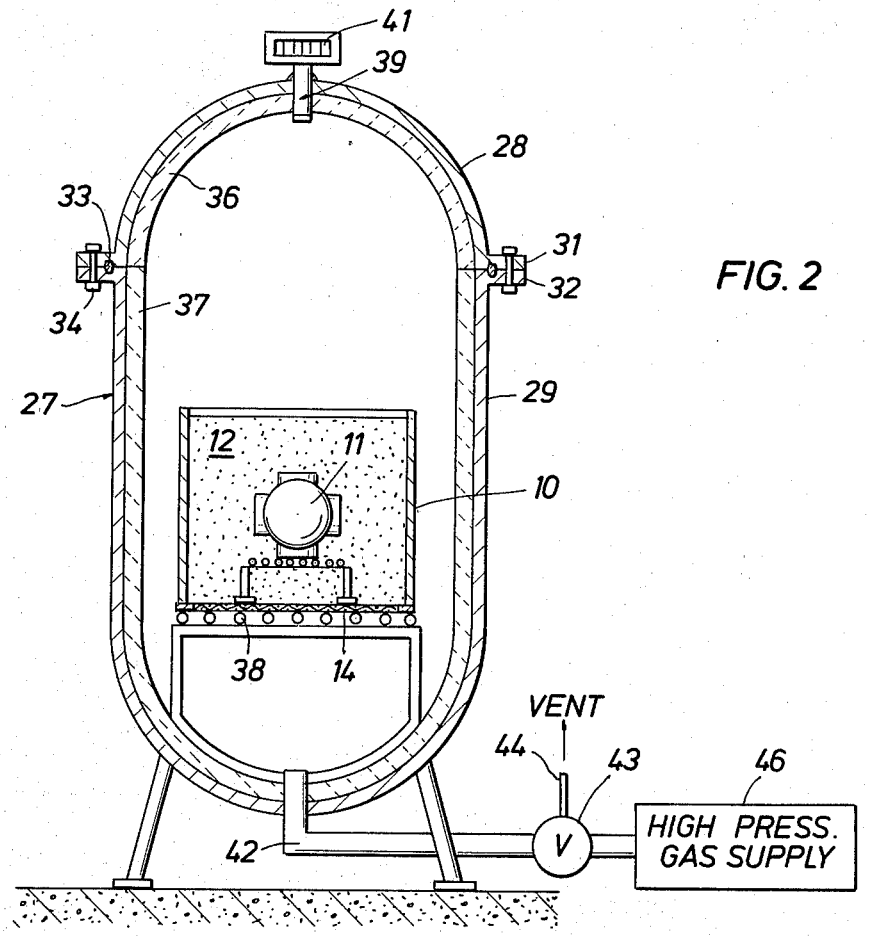
FIG. 2 is a section of an autoclave that is employed in practicing the present process of hot isostatic pressing of a metal workpiece.

When the workpiece 11 and the bed 12 are at the desired temperature condition, the container 10 is transferred to the apparatus shown in FIG. 2. This apparatus comprises an autoclave 27 with a removable hemispherical cover 28 mounted upon a fixed hemispherical bottom section 29. The cover 28 and section 29 carry flanges 31 and 32 seated fluid tight with a sealing ring 33 secured by bolts 34. The interior of the autoclave 27 can be covered by insulation coverings 36 and 37 secured to the cover 28 and section 29, respectively. A supporting rack 38 rests upon the bottom of the section 29 and is adapted to support the container 10.

The autoclave 27 is provided with a pressure sensor 39, preferably of the solid state type with a direct readout display 41. Also, the autoclave 27 is connected to a gas manifold 42 having a multiport valve 43 that is selectively connectable to a vent pipe 44 or a high pressure gas source 46. The source 46 is conventional in design to provide a suitable gas (nitrogen or air) at pressures in excess of 20,000 psi above atmospheric within the autoclave 27. Nitrogen gas should be used if significant amounts of carbonous residue are present in the bed to avoid uncontrolled heating effects.

With the container 10 sealed within the autoclave 27, the valve 43 is adjusted to bring the pressure therein to superatmospheric pressure of at least 20,000 psi, and preferably to a pressure between 20,000 psi and 50,000 psi. Then, this superatmospheric pressure is maintained for a sufficient period of time to effect the desired hot isostatic pressing results. Usually, the pressure is held constant for at least a few minutes but one hour is generally more than sufficient for the desired results. Depending on the metal of the workpiece, the minimum required time of applying superatmospheric pressure to the workpiece may be determined empirically.

Although the bed 12 is not fluidized it is very porous and permeable to induced gas flow. Therefore, the same superatmospheric pressure is applied to the workpiece 11 on all three axis. Furthermore, the bed 12 functions to maintain uniformly the workpiece 11 at precisely the desired pre-established temperature in the plastic range of the metal.

After lapse of a suitable time to achieve hot isostatic pressing of the workpiece 11, the autoclave 27 is vented by valve 43 via vent 44 to atmospheric pressure, and the container 10 is removed. Now, the workpiece 11, with improved mechanical structure resulting from hot isostatic pressing, is removed from the bed 11 and it is ready for subsequent utilization as a manufactured product. The hot bed 12 may be used again in this process, if desired.

From the foregoing, it will be apparent that there has been provided a process for hot isostatic pressing of a metal workpiece that can produce a desired treatment result with greater efficiency, superior control in both constant and uniform temperature and superatmospheric pressure than the hot working procedures which have been employed up to the present time. In addition, the present invention requires very minimal manual manipulations of the workpiece. It will be understood that certain features and alterations of the present process may be employed without departing from the spirit of this invention. These changes are contemplated by and are within the scope of the appended claims. It is intended that the present description be taken as an illustration of a preferred embodiment of the present process.

What is claimed is:

1. A process for treating a metal workpiece comprising the steps of:

(a) subjecting the workpiece to a fluidized particulate bed at a temperature of a first level until the workpiece throughout reaches substantially this temperature at the first level;

(b) terminating fluidization of the bed;

(c) subjecting the workpiece to superatmospheric gas pressure while leaving the workpiece in the bed at a relatively constant temperature of about the first level until pressure and temperature dependent internal structural changes have occurred in the workpiece; and (d) removing the workpiece from the bed and superatmospheric pressure for subsequent utilization.

2. The process of claim 1 wherein said workpiece consists of a ferrous metal and the temperature of the first level is at least 2000° F. in the plastic range of the metal.

3. The process of claim 1 wherein the superatmospheric pressure is at least 20,000 psi.

4. The process of claim 1 wherein the superatmospheric pressure is in the range of 20,000 psi to 50,000 psi.

5. The process of claim 2 wherein the temperature of the first level is at least 2000° F. and the superatmospheric pressure is at least 20,000 psi.

6. The process of claim 5 wherein the temperature of the first level is in the range of 2000° F. to 2600° F.

7. The process of claim 1 wherein the temperature of the first level is in the plastic range of the metal and the superatmospheric pressure is sufficient in magnitude to produce an internal pressure change in the metal workpiece to effect hot isostatic pressing.

8. The process of claim 7 wherein the workpiece is returned to atmospheric pressure, removed from the particulate bed and then cooled to a reduced temperature.

9. The process of claim 8 wherein the heated particulate bed from which the workpiece is removed is employed for heating another workpiece to the temperature of the first level.

10. In the process for the hot isostatic pressing of a metal workpiece, the improvement comprising the steps of:

(a) subjecting the workpiece in a particulate bed of the type adapted to be fluidized to a temperature in the plastic range of the metal;

(b) applying to the workpiece in the particulate bed of a superatmospheric pressure sufficient in magnitude to effect hot isostatic pressing while the workpiece is in the particulate bed at a relatively constant temperature in the plastic range of the metal; and (c) removing the workpiece from the superatmospheric pressure and the particulate bed for subsequent utilization.

11. The process of claim 10 wherein the workpiece consists of ferrous metal, the temperature is at least 2000° F. and the superatmospheric pressure is at least 20,000 psi.

12. The process of claim 11 wherein the temperature is in the range of 2000° F. and 2600° F., and the superatmospheric pressure is in the range of 20,000 psi to 50,000 psi.

13. The process of claim 10 wherein the temperature and superatmospheric pressure are sufficient in magnitude to produce internal changes in the workpiece for reducing voids such as cracks and improving mechanical properties thereof.

* * * * *